United States Patent [19]

Grindle

[11] 3,944,810

[45] Mar. 16, 1976

[54] LUMINARE

[75] Inventor: James L. Grindle, Hendersonville, N.C.

[73] Assignee: General Electric Company, N.Y.

[22] Filed: Feb. 18, 1975

[21] Appl. No.: 550,209

[52] U.S. Cl. ..... 240/103 R
[51] Int. Cl.[2] ..... F21V 7/14
[58] Field of Search ..... 240/103 R, 41.35 R

[56] References Cited

UNITED STATES PATENTS

| | | | |
|---|---|---|---|
| 1,753,885 | 4/1930 | Gerhardt | 240/103 R X |
| 2,414,657 | 1/1947 | Mitchell | 240/103 R |
| 2,640,148 | 5/1953 | McCandless | 240/103 R |

*Primary Examiner*—L. T. Hix
*Assistant Examiner*—E. M. O'Connor
*Attorney, Agent, or Firm*—Sidney Greenberg

[57] ABSTRACT

Dome-shaped reflector in indoor luminaire having a high intensity lamp and mounted at relatively low height has the lower portion of its reflecting surface formed to reflect light downwardly at an angle of not more than about 50% of the cut-off angle formed by the rim of the reflector relative to the lamp, so as to provide low glare at viewing angles of about 65°–85° from nadir. The cut-off angle is not more than 65°.

10 Claims, 2 Drawing Figures

LUMINARE

Figure 1:
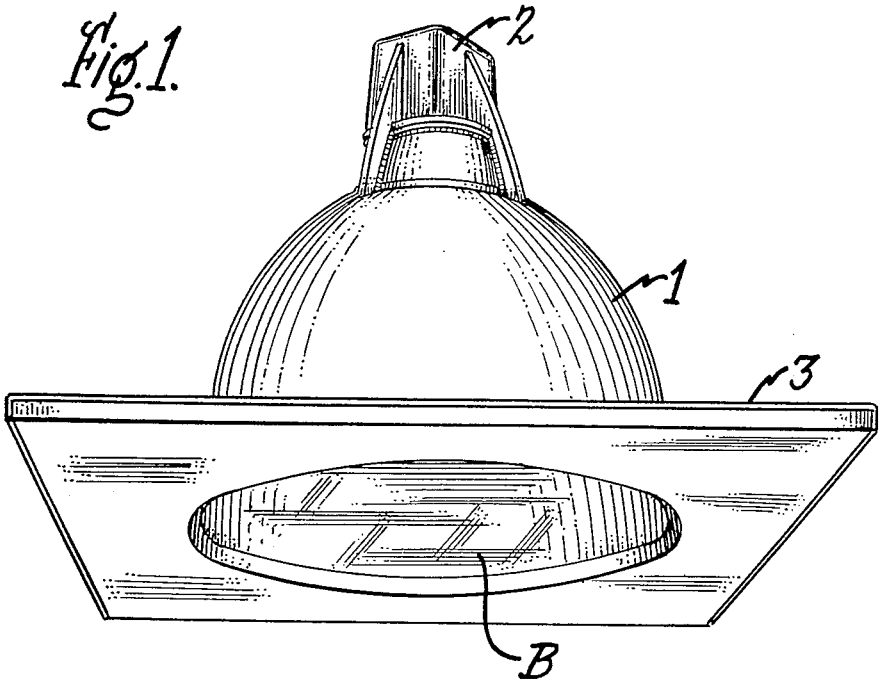

The present invention relates to luminaires, and particularly to reflectors of luminaires such as used for indoor lighting purposes.

Luminaires of the above type which comprise dome or bell shaped reflectors in which a high intensity gaseous discharge lamp is mounted have been widely used heretofore for indoor industrial applications, such as in factories, where the luminaires are mounted relatively high above the floor, and accordingly have not produced objectionable glare in the field of view of persons working in the area illuminated by the luminaires. Such luminaires, however, have recently come into increasing use in commercial establishments such as retail stores and supermarkets, where the luminairies are mounted at relatively low heights above the floor, e.g., 8 to 14 feet high. In such applications, the light output can result in very objectionable glare to the viewer. Prior methods used in attempts to overcome this problem have included etching the reflector surface or providing facets or flutes thereon, or otherwise diffusing the reflected light. Other methods have included the use of light baffles or louvers to intercept the glare light. Such prior methods, however, have not been found satisfactory for various reasons, such as excessive cost, inadequate reduction of glare, reduced lighting efficiency, undesirable appearance, or other deficiencies.

Accordingly, it is an object of the invention to provide a luminaire of the above type having a reflector which overcomes the above disadvantages, especially when the luminaire is mounted at relatively low height.

A particular object of the invention is to provide a luminaire reflector of the above type which avoids objectionable glare in the critical viewing angles for a viewer in the vicinity while providing uniform distribution of light on the area to be illuminated by the luminaire.

Still another object of the invention is to provide a luminaire of the above type having high efficiency and reasonably wide distribution for use in indoor applications requiring low mounting heights.

Other objects and advantages will become apparent from the following description and the appended claims.

With the above objects in view, the present invention in one of its aspects relates to a luminaire comprising, in combination, a concave reflector having a top and a bottom and formed by a wall extending about an axis and having a rim defining a bottom opening, and a lamp mounted within the reflector and having a light center substantially on the axis, the lamp being arranged so that a straight line between and tangent to the rim and the bottom of the lamp forms a vertical cut-off angle of predetermined amount relative to the axis, the reflector having an inner reflecting surface portion extending a substantial distance upwardly from the rim and formed to reflect light incident thereon from the light center downwardly at a vertical angle relative to the axis of not more than about 50% of the cutoff angle.

Figure 2:
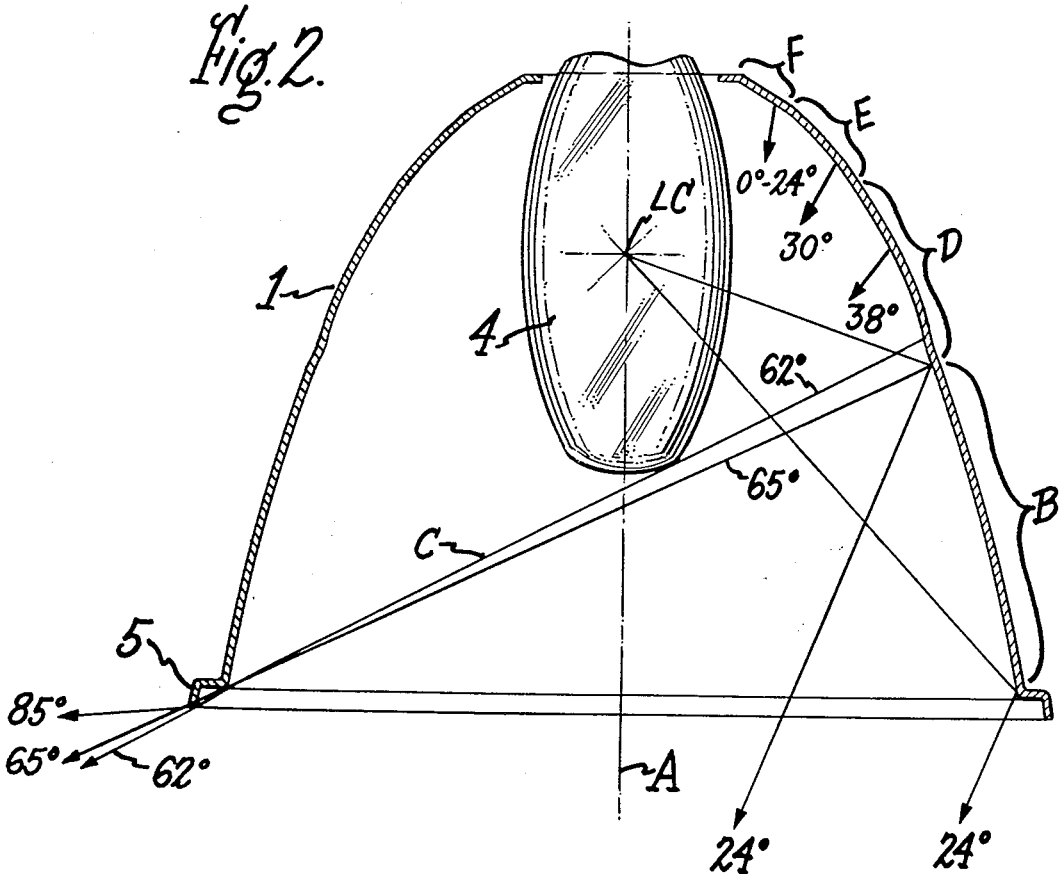

The invention will be better understood from the following description taken in conjunction with the accompanying drawing, in which:

FIG. 1 is a perspective view of an indoor luminaire in which the invention may be embodied; and FIG. 2 is a somewhat enlarged view of a portion of the FIG. 1 luminaire showing the reflector in vertical section and including light ray diagrams.

Referring now to the drawing, and particularly to FIG. 1, there is shown an indoor luminaire in which the invention may be embodied and comprising a concave dome shaped reflector 1 surmounted at its top by a lamp socket housing 2 and having an apertured panel 3 attached to its bottom with the panel aperture in register with the bottom opening of reflector 1. Panel 3 is a ceiling lay-in panel od conventional type which enables the luminaire to be installed in ceiling grid supports and does not form a part of the present invention.

As seen in FIG. 2, lamp 4, typically of high intensity gaseous discharge type such as a mercury or sodium vapor lamp, is mounted in the upper portion of reflector 1 with its light center LC on the vertical axis A of the reflector. The neck of lamp 4 extends upwardly through an opening in the top of reflector 1, and the base of lamp 4 is removably secured to a lamp holder or socket (not shown) arranged within socket housing 2. Rim 5 at the bottom of reflector 1 defines a bottom opening through which direct light from lamp 4 and reflected light from reflector 1 passes downwardly toward the area to be illuminated. In a usual case, the interior walls of reflector 1 have smooth specular reflecting surfaces.

As used herein, the expression "critical viewing angles" refers to the high angles above nadir in the range of 65°–85°. It is in this range that glare is a particular problem when the luminaire is arranged at relatively low mounting heights, since the observer is more likely to see the inside of the reflector from these angles at a distance much closer to the luminaire than if the luminaire were at greater mounting heights.

By "vertical angle" is meant the angle up from nadir defined by a line (or light ray) relative to the vertical axis of the luminaire.

In order to maintain low brightness, i.e., to avoid glare, in the critical viewing angles in accordance with the invention, light incident on the interior surfaces of reflector 1 in the area visible at these angles is reflected at relatively low vertical angles so that it is not directed into the viewer's eyes. This visible area on the inside of the reflector is the area B, as seen in FIG. 1, at the lowermost portion of the reflector which extends from the bottom rim 5 upwardly to approximately the point of intersection on reflector 1 of the line C Which is tangent to reflector rim 5 and the bottom of lamp 4. Line C defines the vertical cut-off angle of the luminaire, that is, the angle above which lamp 4 is not visible to the observer.

In accordance with the invention, the luminaire is constructed so that the cut-off angle is not more than about 65° and the reflector area B which is in the range of critical viewing angles is formed so that light rays incident thereon from light center LC of lamp 4 are reflected at vertical angles of not more than about 50% of the cut-off angle. In a particularly preferred embodiment, reflecting area B is parabolic in vertical section with light center LC arranged at the focus thereof, the arrangement being such that light from the light center is reflected downwardly in parallel rays along the axis of the parabolic section B at a vertical angle of about 24°.

It will be understood, of course, that all of the light from lamp 4 does not originate solely at its light center, and the light source actually may extend over a substantial region within lamp 4, especially if the lamp is a phosphor-coated type. Accordingly, the description of light rays being reflected downwardly at about 24° refers to the average angle of the reflected light, since the light will be scattered at various angles near that angle for the reasons mentioned. However, by virtue of providing for reflection of light from reflector area B at angles considerably below the cut-off angle in accordance with the invention, very little light will spill over into the critical viewing angles and any glare thereby is reduced to an insignificant amount.

While a parabolic form of reflecting area B is preferred, this area may be of other configuration, or even straight, provided that it is so formed and arranged that a significant amount of light is not reflected therefrom at vertical angles greater than about 50% of the cut-off angle.

The remaining reflector area above area B is above the critical viewing angles and hence does not present significant problems of glare such as the lower reflector areas do. In general, the upper reflector porton has an appropriate configuration to provide uniform illumination and desired light distribution on the floor below the luminaire, and to supplement the main light distribution provided by light reflected by area B and direct light from lamp 4. The configuration of the upper reflector portion should be such, however, that light rays reflected from this portion are not at such high angles that they strike reflector 1 on the opposite side in the area visible in the critical viewing angles. Such secondary reflections would not only lower the efficiency of the luminaire but would also be reflected out of the luminaire at high angles causing glare to the viewer.

In a particular embodiment which has been found satisfactory, area D of the reflector is parabolic having its axis at about 38° and its focus at light center LC, area E is parabolic having its axis at about 30°and its focus at LC, and area F is straight and arranged to reflect light beams at less than 24°.

In a usual installation, lamp 4 is selectively adjustable to different vertical positions along axis A of the luminaire in order to achieve varying beam spreads below the luminaire. In such adjustment the above described relationship between the cut-off angle and the angle of reflection from the visible area B is still maintained, since increasing the cut-off angle also increases the reflected angle, and conversely, decreasing the cut-off angle decreases the reflected angle. For optimum results, in the usual installations of the described luminaire, the lamp should not be lowered below the level at which a cut-off angle of about 65° is exceeded. In normal installations, the cut-off angle of the luminaire will be in the range of about 45°to 65°, with about 62° being typical. However, it will be evident that the invention is applicable even to luminaires having a cut-off angle below the aforementioned range.

The invention is particularly applicable to open bottom luminaire reflectors in which light transmitting closures such as glass or plastic lenses or refractors are omitted, for reasons of economy, avoidance of heat buildup or other reasons. However, a plain light transmitting cover may be employed with the described reflector without departing from the scope of the invention.

It will also be understood that various modifications may be made in the particular form of the reflector shown and described while still coming within the scope of the invention. For example, instead of having smooth surfaces, the reflector may have faceted reflecting surfaces, such as disclosed in U.S. Pat. No. 3,662,165, assigned to the same assignee as the present invention. Where appropriate or desirable, the reflecting surfaces of the reflector, instead of being specular, may be made diffusing by any suitable means.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the U.S. is:

1. A luminaire comprising, in combination, a concave reflector having a top and a bottom and formed by a wall extending about an axis and having a rim defining a bottom opening, and a lamp mounted in said reflector and having a light center substantially on said axis, said lamp arranged so that a straight line between and tangent to said rim and the bottom of said lamp form a vertical cut-off angle of not more than about 65°relative to said axis, said reflector having an inner reflecting surface portion extending a substantial distance upwardly from said rim and formed to reflect substantially all the light incident thereon from said light center downwardly at a vertical angle relative to said axis of not more than about 50% of said cut-off angle.

2. A luminaire as defined in claim 1, said straight line intersecting said reflector wall a predetermined distance above said rim, said reflecting surface portion extending approximately said predetermined distance upwardly from said rim.

3. A luminaire as defined in claim 2, said cut-off angle being not more than about 65°, said vertical angle being substantially less than 30°.

4. A luminaire as defined in claim 1, said reflector having an upper reflecting surface portion extending above said first-mentioned surface portion and formed to reflect light from said light center downwardly through said bottom opening at vertical angles substantially less than said cut-off angle.

5. A luminaire as defined in claim 1, said vertical angle being substantially less than 30°.

6. A luminaire as defined in claim 1, said reflecting surface portion being parabolic in vertical section with its focus approximately at said light center.

7. A luminaire as defined in claim 6, said cut-off angle being about 62°–65°, the axis of said parabolic surface portion being less than about 30°.

8. A luminaire as defined in claim 7, said reflector having an upper reflecting surface portion extending above said first-mentioned surface portion and formed to reflect light from said light center downwardly through said bottom opening at vertical angles substantially less than said cut-off angle.

9. A luminaire as defined in claim 1, wherein said surface portion has a specular reflecting surface.

10. A luminaire as defined in claim 1, wherein said concave reflector is dome-shaped.

* * * * *